United States Patent [19]

Krakauer

[11] 4,087,020

[45] May 2, 1978

[54] ARTICLE VENDING MACHINE HAVING ROTARY STORAGE COMPARTMENTS

[76] Inventor: Merrill Krakauer, 1 Deer Path, Short Hills, N.J. 07078

[21] Appl. No.: 701,881

[22] Filed: Jul. 1, 1976

Related U.S. Application Data

[63] Continuation-in-part of Ser. No. 582,388, May 30, 1975, abandoned.

[51] Int. Cl.[2] ..... G07F 11/82

[52] U.S. Cl. ..... 221/84; 221/155; 221/197

[58] Field of Search ..... 221/75, 83, 129, 155, 221/81, 197, 79, 90, 155, 298, 299, 301, 82, 84

[56] References Cited

U.S. PATENT DOCUMENTS

| | | | |
|---|---|---|---|
| 2,493,956 | 1/1950 | Ewertz | 221/81 |
| 2,687,825 | 8/1954 | Galin et al. | 221/82 |
| 3,164,294 | 1/1965 | Phillips et al. | 221/84 |
| 3,253,736 | 5/1966 | Moyer et al. | 221/84 |
| 3,512,679 | 5/1970 | Stoltz | 221/155 X |
| 3,991,907 | 11/1976 | Kull | 221/84 |
| 4,003,497 | 1/1977 | Kurimsky | 221/84 |

*Primary Examiner*—Stanley H. Tollberg
*Attorney, Agent, or Firm*—Shenier & O'Connor

[57] ABSTRACT

A merchandising machine made up of a plurality of generally vertical panels extending from adjacent to the top of the cabinet to a location adjacent to the cabinet delivery opening and each of which panels supports upper and lower generally circular merchandise supply carriers having a plurality of radially extending article storage compartments and each of which carriers is adapted to be driven in the course of a cycle of operation of the machine to position a compartment to deliver its article to an escrow assembly adapted to be actuated to deliver an article from a display surface positioned behind a window in the cabinet to the delivery mechanism at the delivery opening. Each carrier is provided with an ejector adapted to be moved into the compartment positioned adjacent to the escrow assembly positively to move an article from the compartment to the display surface. A lock is provided for locking the delivery door of the delivery mechanism closed during a cycle of operation of the machine.

50 Claims, 14 Drawing Figures

ARTICLE VENDING MACHINE HAVING ROTARY STORAGE COMPARTMENTS

This application is a continuation in part of my copending application Ser. No. 582,388, filed May 30, 1975 now abandoned.

BACKGROUND OF THE INVENTION

My invention relates to a merchandising machine and, more particularly, to a merchandising machine of the type which is adapted to deliver a wide variety of articles such as candy bars, pastries, cigarettes, packages or the like to a purchaser in response to the deposite in the machine of a sum of money aggregating at least the purchase price of the article.

There are known in the prior art merchandising machines which are adapted to deliver a wide variety of products in an expeditious manner. Examples of machines of this type are shown in my prior U.S. Pat. Nos. 3,269,595 and 3,344,953, for example. The machines shown in my prior patents have delivery units which include helical coils adapted to receive articles between adjacent turns thereof and adapted to be driven to deliver the foremost article over the edge of the shelf upon which the coils are mounted to a tray at which it is accessible to the customer.

In the merchandising machine industry a certain standard height of cabinet and a standard convenient height of the location at which articles of merchandise are delivered to the customer have been adapted. These two criteria determine the space available within the cabinet for the merchandise storage and delivery mechanism of the machine if expensive mechanisms for lifting articles from supplies below the delivery opening and then delivering the article are to be avoided.

There are also known in the prior art merchandising machines each unit of which includes an endless articulated belt or chain carrying a plurality of article storage shelves. Each belt or chain extends from a location adjacent to the top of the cabinet to a location adjacent to the delivery opening. The belt or chain may be adapted to deliver an article from one of its shelves to an escrow assembly which is actuated to deliver an article to the customer.

Machines of the type described above incorporate certain disadvantages. A principal disadvantage of machines of the type described hereinabove is their relatively limited capacity for the space occupied by the machine. Stated otherwise, these machines do not at the same time afford a reasonably wide selection of articles while storing adequate supplies of the articles from which the selection can be made. As a result, if a wide selection is to be provided, the machines must be serviced at relatively frequent intervals. Other machines of the prior art do not permit the customer prior to his purchase to see the actual article which he will receive upon making the purchase. In machines of the bin type, the danger exists that the articles may jam in the bins as a result of being loaded with articles which are too large or with too many articles.

Many machines of the type described are provided with a baffle which moves to a position at which it prevents access to the interior of the machine through the delivery opening when the delivery door is opened. The possibility exists that an article being dispensed may be jammed between the baffle and the frame if the door is opened during the operating cycle of the delivery mechanism.

I have invented a merchandising machine which overcomes the disadvantages of merchandising machines of the prior art pointed out hereinabove. My machine affords a relatively wide variety of articles from which a selection can be made while, at the same time, maintaining an adequate supply of each article. My machine makes most efficient use of the available cabinet space. It has twice the capacity for a given space as does a machine of the articulated belt type of the prior art. Each unit of my machine displays the article next to be delivered by that unit. My machine incorporates means for positively moving articles out of the storage compartments of the article supply carrier. My machine obviates the possibility of a delivered article being caught by the anti-theft baffle of the machine. My machine is relatively inexpensive to construct and is reliable in operation.

SUMMARY OF THE INVENTION

One object of my invention is to provide a merchandising machine which overcomes many of the defects of merchandising machines of the prior art.

Another object of my invention is to provide a merchandising machine, the units of which are so constructed as to make most efficient use of the cabinet space available.

A still further object of my invention is to provide a merchandising machine which affords a wide selection of articles while maintaining an adequate supply of each article.

Yet another object of my invention is to provide a merchandising machine in which articles are positively moved out of the storage compartments of the supply carriers.

Yet another object of my invention is to prevent jamming of an article as a result of opening the delivery door of the machine during the operating cycle of the unit thereof.

Still another object of my invention is to provide a merchandising machine which is relatively simple in construction and is certain in operation.

In general, my invention contemplates the provision of a merchandising machine made up of a plurality of units, each of which includes a multi-compartment article storage carrier adapted selectively to be moved through a distance corresponding to the space occupied by one of the compartments to position a compartment adjacent to the upper end of an inclined escrow shelf located behind the cabinet display window with the upper end thereof adjacent to the supply carrier and with the lower end thereof relatively adjacent to the delivery tray of the machine. A baffle member having upper and lower baffles is adapted to be moved from a first position at which the lower baffle prevents movement of an article on the escrow shelf to the delivery tray to a second position in response to movement of the supply carrier at which the lower baffle permits the displayed article to fall by gravity to the delivery tray, while the upper baffle moves to a position at which it prevents an article from moving from the supply compartment to the delivery tray. Upon completion of movement of the article carrier, the baffles return to their initial positions so that the next article is permitted to move onto the display tray. Following the movement of the carrier, an ejecting means is moved into the compartment positioned to deliver its article to the tray to ensure that the article moves onto the tray in the event it had been stuck in the compartment. I lock the access door of the delivery tray during a cycle of operation of any one of the units.

BRIEF DESCRIPTION OF THE DRAWINGS

In the accompanying drawings to which reference is made in the following description and in which like reference characters are used to indicate like parts in the various views:

FIG. 13 is a fragmentary side elevation of one of the merchandise storage units of my machine illustrating the merchandise retainer thereof.

DESCRIPTION OF THE PREFERRED EMBODIMENT

Figure 1:
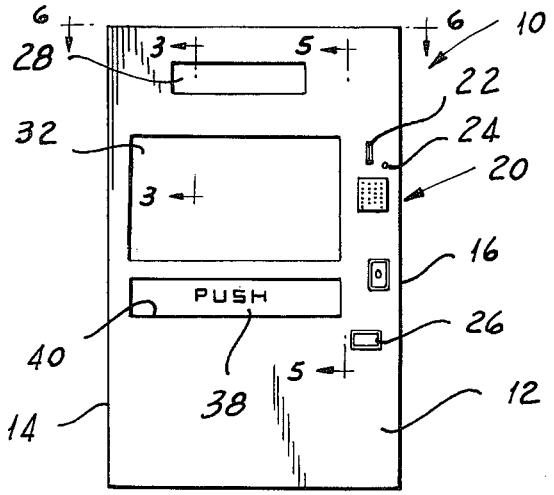
FIG. 1 is a front elevation of my improved merchandising machine.
Figure 2:
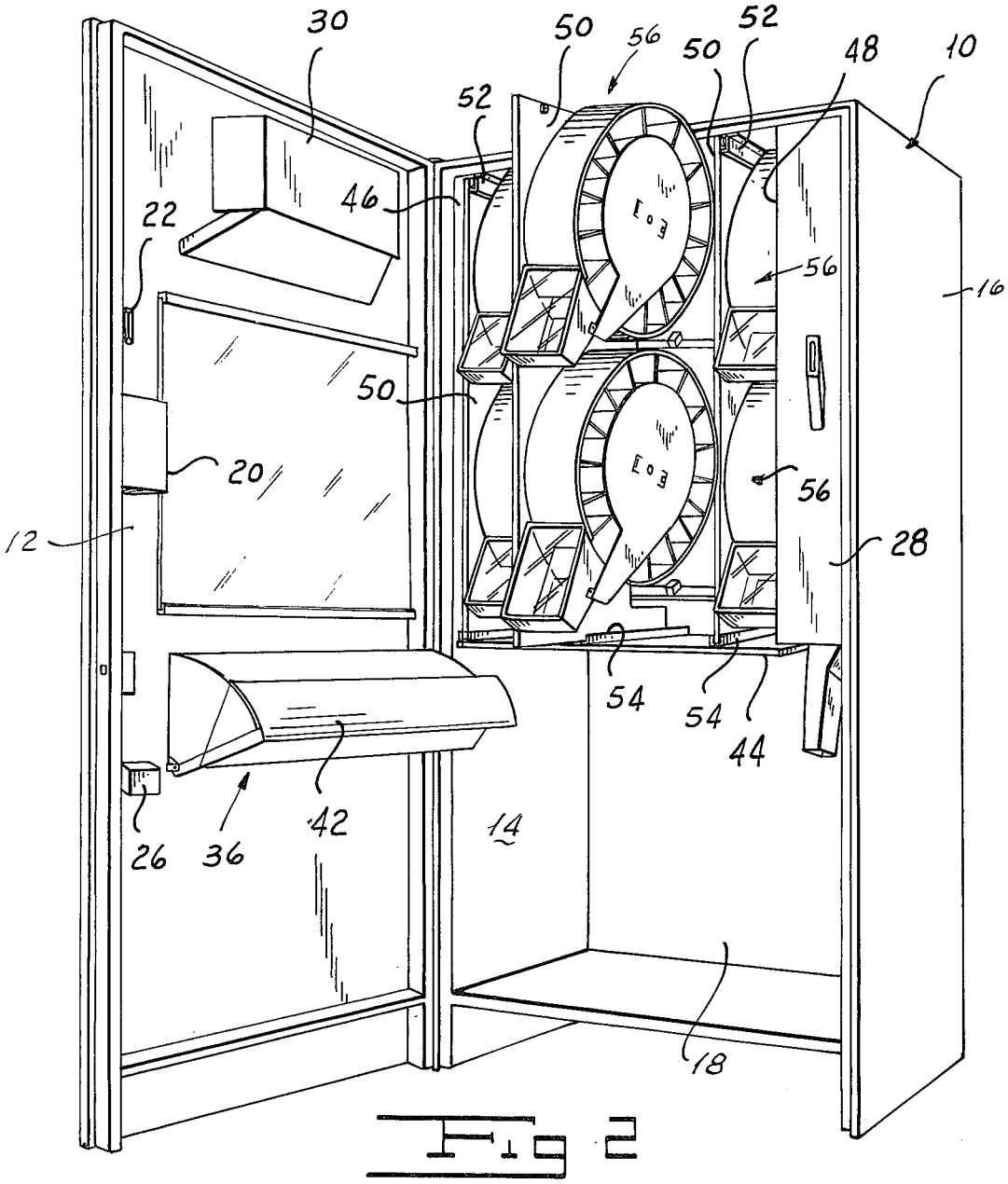
FIG. 2 is a perspective view of my machine shown in FIG. 1 with the door open and with parts thereof omitted for purposes of clarity.

Referring now to FIGS. 1 and 2 of the drawings, my merchandising machine includes a cabinet indicated generally by the reference character 10 having a front door 12, sides 14 and 16, and a back 18. The door 12 carries a push-button assembly indicated generally by the reference character 20 which, in the particular embodiment shown in the drawings, is made up of twenty-two buttons affording twenty-two different selections. By way of example, sixteen of the push-buttons may be employed for goods such as candy, pastry, snacks and the like, while the remaining six buttons may be provided for the selection of articles such as packets of gum and mints.

As is customary, the door 12 carries the coin slot 22, the coin return button 24 and the coin return receptacle 26. All of these parts are associated with a coin mechanism 28 of any suitable type shown in the art which, in response to the deposit in the machine of coins aggregating the purchase price of a selected article, enables the corresponding push-button so that upon operation thereof the selected article is delivered.

I provide the door 12 with a relatively small display window 28 associated with the gum and mint delivery units (not shown) mounted on the door 12 by means of a suitable support 30. A window 32 is associated with the units of my machine to be described which are adapted to dispense relatively larger articles. It will be appreciated that I may provide a single window for all of the units including the gum and mint unit or, alternatively, I might provide separate respective windows for the upper and lower units for delivering larger articles.

The door 12 carries an article delivery mechanism indicated generally by the reference character 36 located at a convenient height to permit the customer to collect one of the articles which has been delivered by a dispensing unit of the machine. The mechanism 36, which will be described in greater detail hereinafter, includes a delivery door 38 which normally closes an access opening 40. I provide my mechanism 36 with a baffle 42 which, as will be described more fully hereinbelow, moves to a position at which access to the operating units of the machine is prevented when the door 38 is opened.

I provide my machine with a horizontal partition 44 in the cabinet at a level between the lower edge of window 32 and the delivery mechanism 42. Side panels 46 and 48 extending from the top of the cabinet downwardly to the partition 44 are provided with respective arcuate slots to be described more fully hereinafter. My machine includes a plurality of vertically extending panels 50 slidably supported above the shelf 44 at spaced locations between the side panels 46 and 48. By way of example, the upper ends of the panels 50 may be carried by hangers 52 while the lower edges of the panels ride in channels 54 on the upper surface of the partition 44. Thus, each of the panels can be moved from a housed position to a position out of the housing at which the merchandising units to be described may be loaded. For purposes of simplicity, I have illustrated only three of the panels 50 in FIG. 2 of the drawings.

Figure 3:
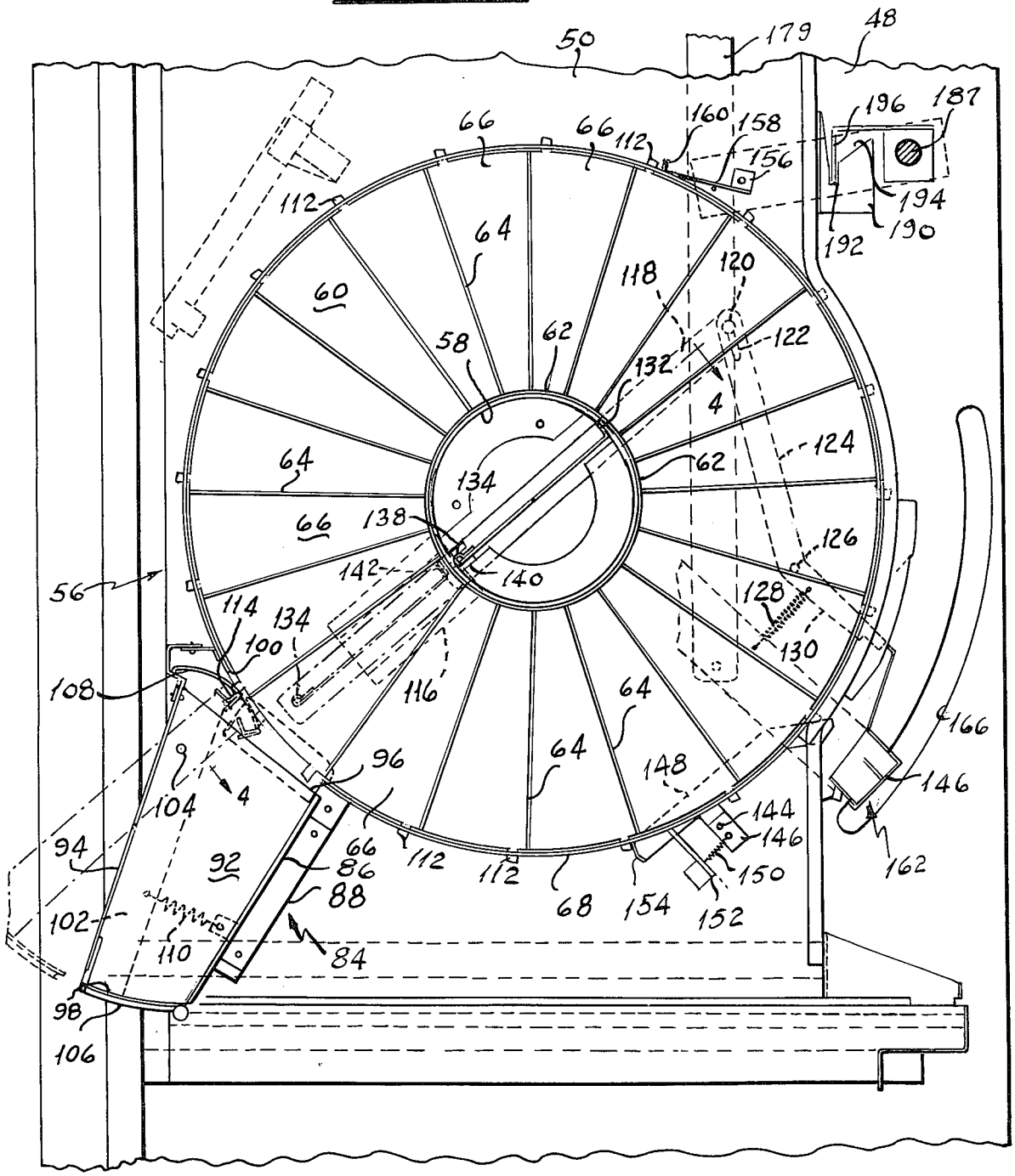
FIG. 3 is a fragmentary section of the machine shown in FIG. 1 taken along the line 3—3 thereof and drawn on an enlarged scale to illustrate the details of one of the supply units of the machine.

Referring now to FIGS. 2 and 3, I mount two of my merchandise delivery units, each of which is indicated generally by the reference character 56, in superposed relationship on each of the panels 50. Each of the units 56 includes a stationary hub 58 secured to the corresponding panel 50 by any suitable means such, for example, as screws or the like. Each hub 58 rotatably receives an article supply carrier made up of an annular plate 60 formed with a hub 62 received by the hub 58 and further formed with a plurality of radially extending partitions 64 dividing the carrier up into a plurality of merchandise storage compartments 66. Any suitable means such, for example, as screws or like may be employed to secure a circular shroud 68 extending around the outer periphery of the article supply carrier to the panel 50 so as to prevent articles from falling out of the compartments 66.

As has been explained hereinabove, each of panels 50 is adapted to be slid outwardly to a position at which the compartments 66 of each of the supply carriers can be loaded from the open sides thereof. Referring now to FIG. 13, I have provided means for ensuring that the articles do not accidentally fall out of the compartments 66 after having been loaded therein and before the panel 50 is moved back into its housed position. Any suitable means such, for example, as rivets 70 secure a retainer plate arm 72 to a bracket 74 pivotally supported on a pin 76 carried by the partition or panel 50. A retainer plate 78 which may be formed from any suitable plastic material is generally circular in configuration and is sufficiently large to cover the open sides of the compartments 66 to a point at which articles held therein are prevented from falling outwardly. For loading, the plate 78 is movable from the full line position shown in FIG. 13 to the broken line position shown in FIG. 13 in which latter position the compartments 66 are accessible for loading. I provide means for releasably retaining the plate 78 in a position at which it retains articles in the compartments 66. As the plate moves from the broken line position to the full line position, a first slightly downwardly bent torque 80 thereof rides under a tab 82 formed on the hub 58. At the same time, a second slightly downwardly bent torque 84 of the plate 78 snaps into position behind the hub 58. It will readily be appreciated that the material of which the retainer 78 is made is somewhat resilient to facilitate these operations.

Referring now to FIG. 3, each of my units 56 includes an escrow display assembly indicated generally by the reference character 84, positioned behind one of the windows 32 or 34, between the delivery assembly 36 and the supply carrier having the compartments 66. The assembly 84 includes an inclined bottom 86 mounted on a bracket 88 secured to the panel 50 by any suitable means. Assembly 84 also includes a side 92 and a transparent top 94 with the upper end 96 and the lower end 98 of the compartment being open. Shroud 68 is provided with an opening 100 at a location adjacent to the upper end 96 of the assembly 84 so as to permit an article in a compartment 66 adjacent to the opening 100 to fall by gravity onto the inclined bottom 86 of the assembly 84.

A lever arm 102 pivotally supported on a pin 104 on one of the sides 92 of the escrow shelf carries a lower baffle 106 and an upper baffle 108. A spring 110 normally urges the lever 102 to a position at which the baffle 106 closes the lower end 98 of the escrow shelf to prevent an article therein from moving by gravity to the delivery mechanism 36 of the machine.

I form the plate 60 with a plurality of peripheral teeth 112 equal in number to the number of compartments 66 in the supply carrier. Further, as will be explained more fully hereinbelow, in operation of the machine one of the teeth 112 is engaged to drive the plate 60 through an angular distance equal to the arc subtended by one of the compartments 66. In the course of this operation, another tooth 112 on the plate 42 engages a lug 114 on the upper baffle 108 to swing lever 102 in a clockwise direction around its pivot 104 to the broken line position illustrated in FIG. 3 in which position the lower baffle 106 permits an article which had been displayed on the base 86 to fall to the delivery mechanism 36. At the same time, the baffle 108 is moved with the plate 60 so as to prevent an article from the compartment next to deliver its article to the escrow mechanism from moving into the housing. As the plate 60 completes its step of movement, the lug 114 is released by the tooth 112 and spring 110 returns the baffles 106 and 108 to their initial positions. When this occurs, the article from the compartment which has been positioned adjacent to the upper end of the escrow display shelf 86 is permitted to move onto the upper surface of the shelf.

Each of my units 56 includes an ejector mechanism for positively driving an article out of a compartment 66 positioned adjacent to the escrow assembly 84. Each partition 50 carries an ejector bar guide 116 which slidably receives an ejector bar 118 for movement along a line extending through the axis of rotation of the plate 60. A pin 120 on one end of the arm 118 rides in a slot 122 in an arm 124 of a bell crank pivotally supported on a pin 126 on the panel 50. A spring 128 extending between the arm 124 and the panel 50 normally urges the bell crank to rotate in a clockwise direction to a limit position to be described. The bell crank includes a second arm 130 adapted to be driven in a manner to be described to move the bell crank in a counterclockwise direction as viewed in FIG. 3.

A bracket 132 on bar 118 intermediate the ends thereof extends into the interior of the hub 58. Any suitable means such, for example, as a rivet or the like secures the ejector 134 to the bracket 132 on the bar 118. The limit position to which the spring 128 urges the mechanism is that at which the bracket 132 engages the inner surface of hub 58. I form hub 58 with a pair of guides 138 and 140 at the sides of an opening 142 in the hub which permits the ejector 134 to enter a compartment 66 positioned adjacent to the escrow mechanism 86 when the machine operates in a manner to be described.

I provide each of the units 56 with means for preventing unintended movement of the supply carrier in either direction of rotation. A pin 144 on the panel 50 pivotally supports a lateral extension 146 on a lever 148. A spring 150 extending between the extension 146 and a bracket 152 forming part of the shroud support mechanism normally urges the lever 148 to move in a clockwise direction to a position at which a stop 154 at one end of the lever is in front of a tooth 112 on the plate 60 so as to prevent counterclockwise movement of the article supply carrier. The other end of lever 148 is slightly bent so as to be actuated by the operating mechanism associated with the unit in a manner to be described to cause the lever to be pivoted against the action of spring 150 to a position at which stop 154 is out of the path of a tooth on the supply carrier. A pin 156 on panel 50 adjacent to the upper right hand quadrant of the supply carrier pivotally supports an arm 158 which rests by gravity on the edge of plate 60 with a stop 160 on the arm adjacent a tooth 112 to prevent clockwise movement of the supply carrier as viewed in FIG. 3. In this manner, I prevent unintended movement of the article carrier in both directions.

Figure 6:
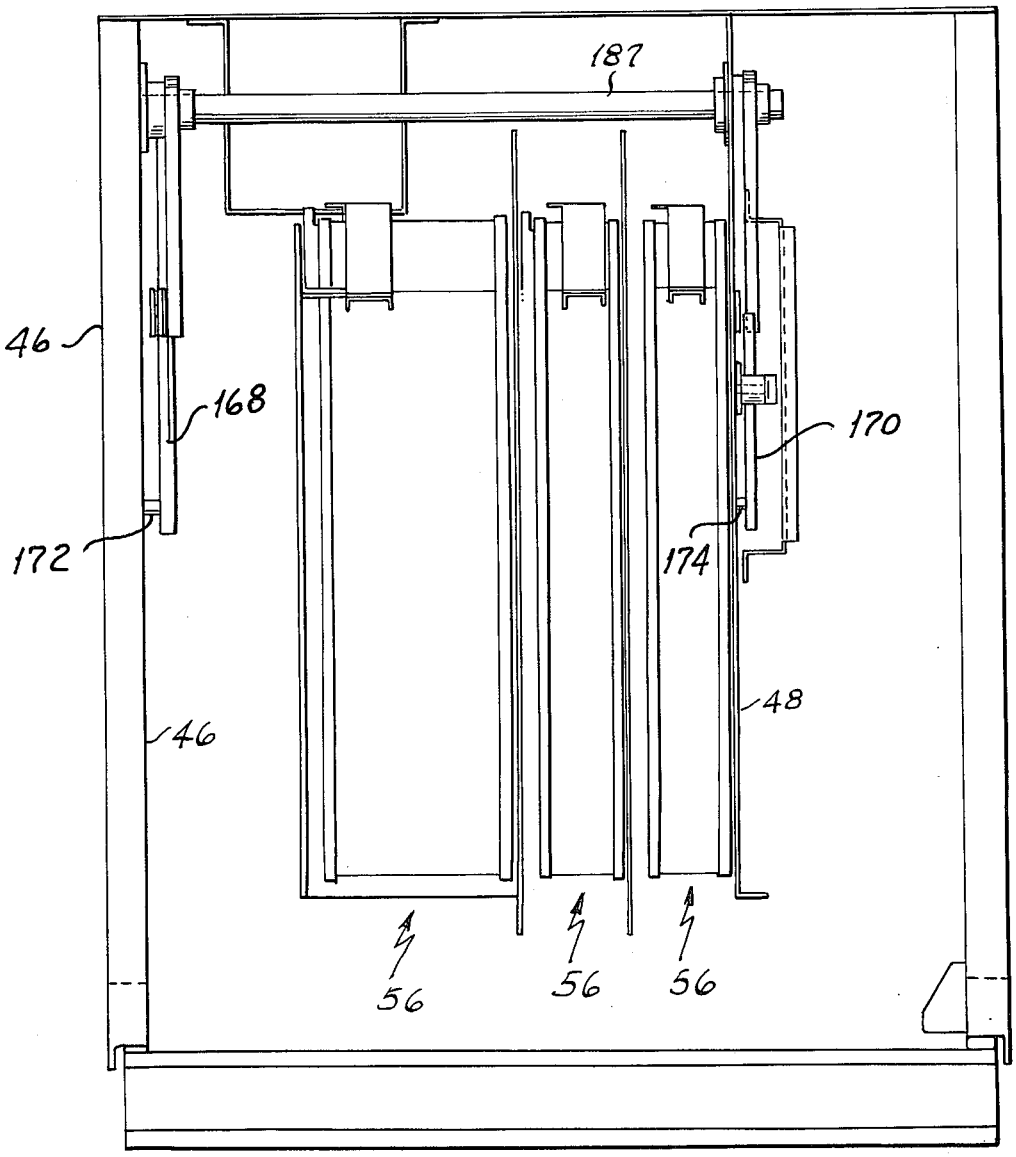
FIG. 6 is a fragmentary section of my merchandising machine taken along the line 6—6 of FIG. 1 and drawn on an enlarged scale.
Figure 4:
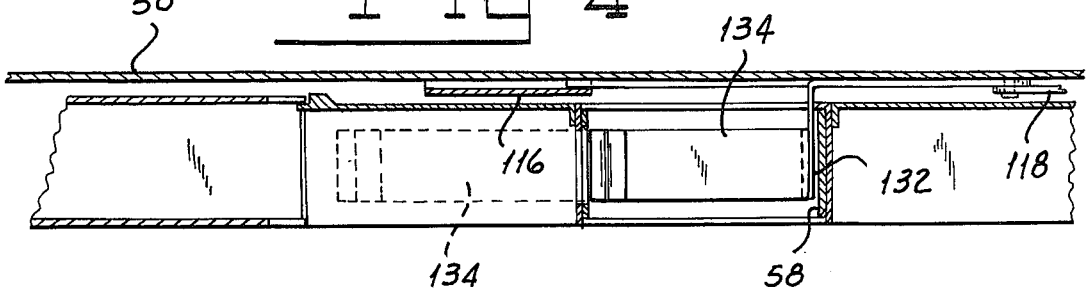
FIG. 4 is a fragmentary section taken along the line 4—4 of FIG. 3.
Figure 5:
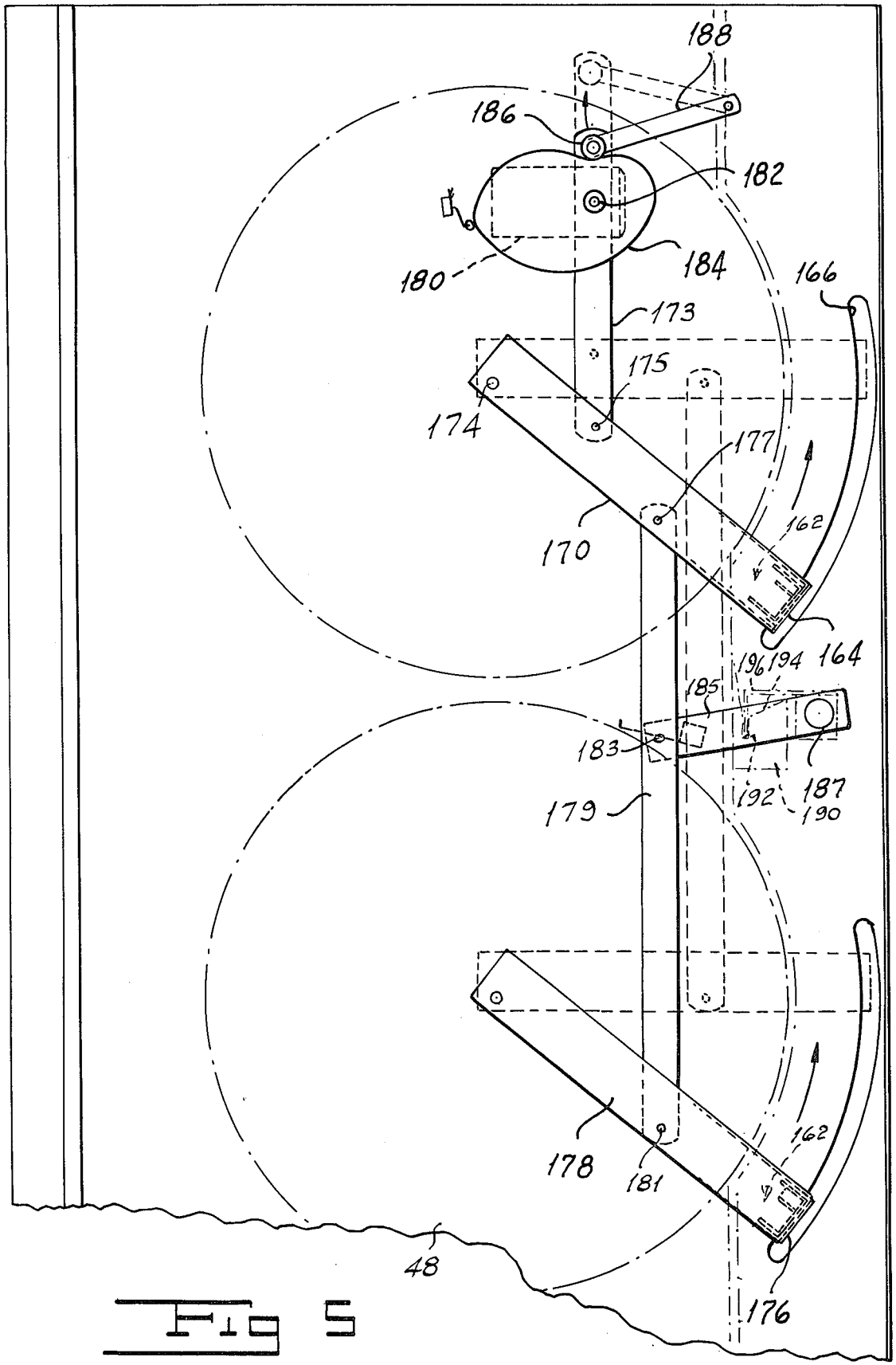
FIG. 5 is a fragmentary section of my merchandising machine illustrating a portion of the drive mechanism of my machine, taken along the line 5—5 of FIG. 1 and drawn on an enlarged scale.

Referring now to FIGS. 5 and 6, I provide a selector assembly indicated generally by the reference character 162 for each of the respective units 56 of the machine. The selector assemblies associated with the upper level units 56 are mounted on a common carrier bar 164 which extends through arcuate slots 166 in the sides 46 and 48. Respective upper carrier bar arms 168 and 170 secured to the upper carrier bar 164 outboard of the sides 46 and 48 are pivotally supported on pins 172 and 174 in the sides 46 and 48 so as to mount the upper carrier bar 164 for swinging movement along an arcuate path corresponding to the arc of the slots 166. A common lower carrier bar 176 supports the selector assemblies 162 associated with the lower level units 56. This lower carrier bar extends through slots similar to slots 166 in the sides 46 and 48 and includes a pair of arms 178 which are pivotally supported for movement about the same axis as the axis of movement of the lower article supply carrier.

A drive motor 180 adapted to be energized when a selection is made has a shaft 182 carrying a cam 184 which drives a follower 186 carried by an arm 188 pivotally supported on the outboard surface of side 48, for example.

A link 173 connects follower 186 to arm 170 to oscillate carriage 164 in slots 166 when cam 184 moves through a complete revolution. A pin 177 connects arm 170 to a link 179, the lower end of which is connected to arm 178 by a pin 181. Thus, as cam 184 goes through a revolution both the upper carriage 164 and the lower carriage 166 oscillate in the slots in sides 46 and 48. A pin 183 connects link 179 to an arm 185 secured to a torsion bar 187 for movement therewith. Bar 187 provides the force against which cam 184 acts in driving the carriages 164 and 166.

I provide each of the panels 50 at the rear thereof with a bracket 190 formed with a slot 192 having a cam surface 194 leading into the slot. When the panel has been moved toward its home position, a locking bar 196 moves downwardly into the slot 192 to draw the panel to a home position to ensure that each of the units 56 thereon is properly positioned with respect to the associated mechanism 162 to permit the machine to function.

Referring now to FIGS. 7 to 10, each of the assemblies 162 associated with the units 56 includes a generally U-shaped bracket 198 having a pair of legs 200 and 202 provided with respective extensions 204 and 206 which receive a pivot pin 208. I pivotally mount the drive member 210 on the pivot pin 208 by means of side flanges 214 and 216 formed on the member 210. A leg 218 formed on the side flange 216 carries a pin 222. I form a latch 224 with a slot 225 which receives the pin 222. The other end of the latch 224 is formed with a hook 226 which is received in a slot 228 in an extension of bracket leg 202 and which hook is adapted to engage the upper end of the slot in a manner to be described. A spring 230 connected between arm 218 and the latch 224 normally urges the parts to a relative position at which the pin 222 is at one end of the slot 225 and member 210 is retracted as shown in full lines in FIG. 7.

Figure 7:
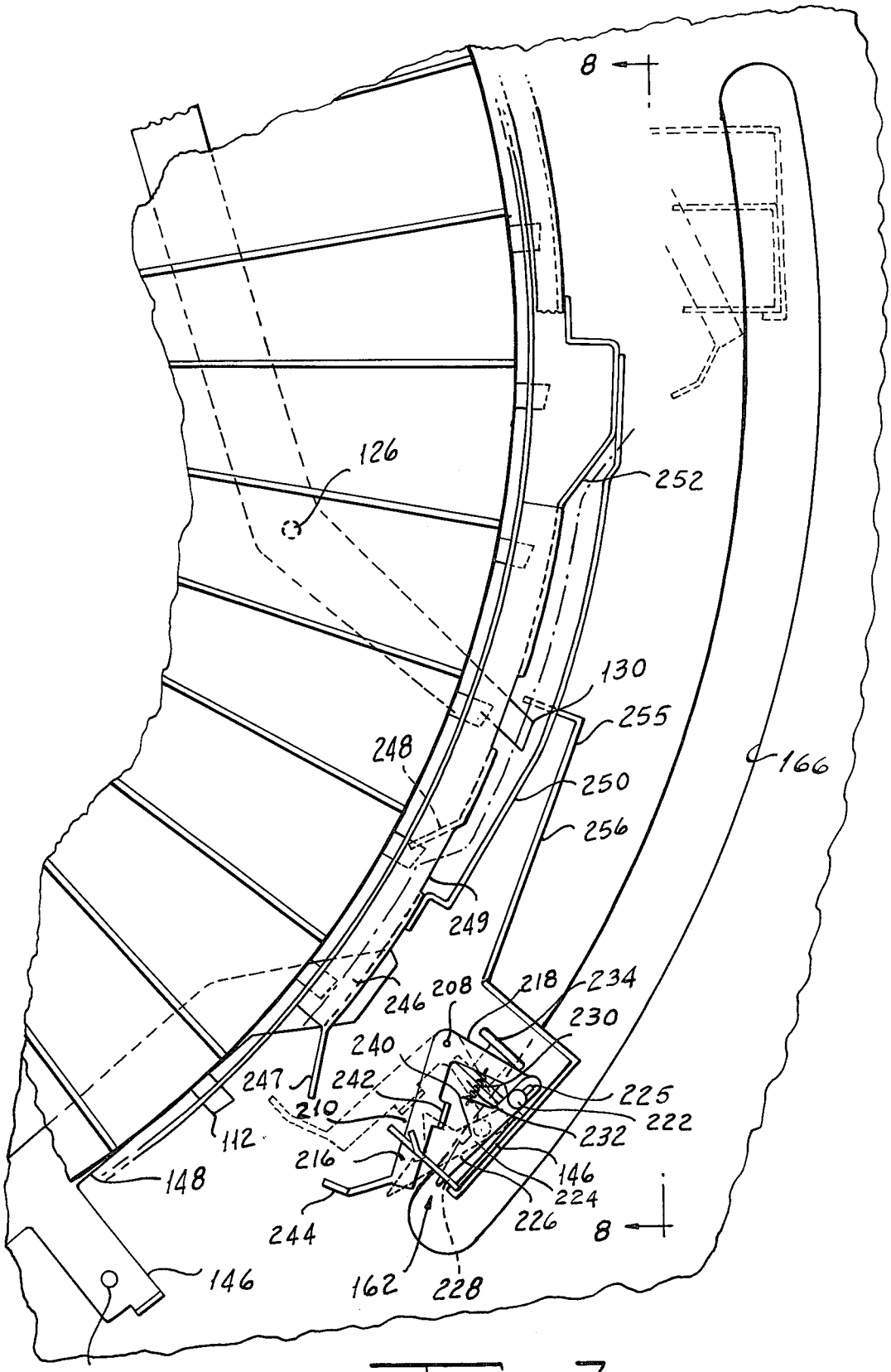
FIG. 7 is a fragmentary side elevation of one of the units of my machine illustrating the selector and drive mechanism thereof.
Figure 8:
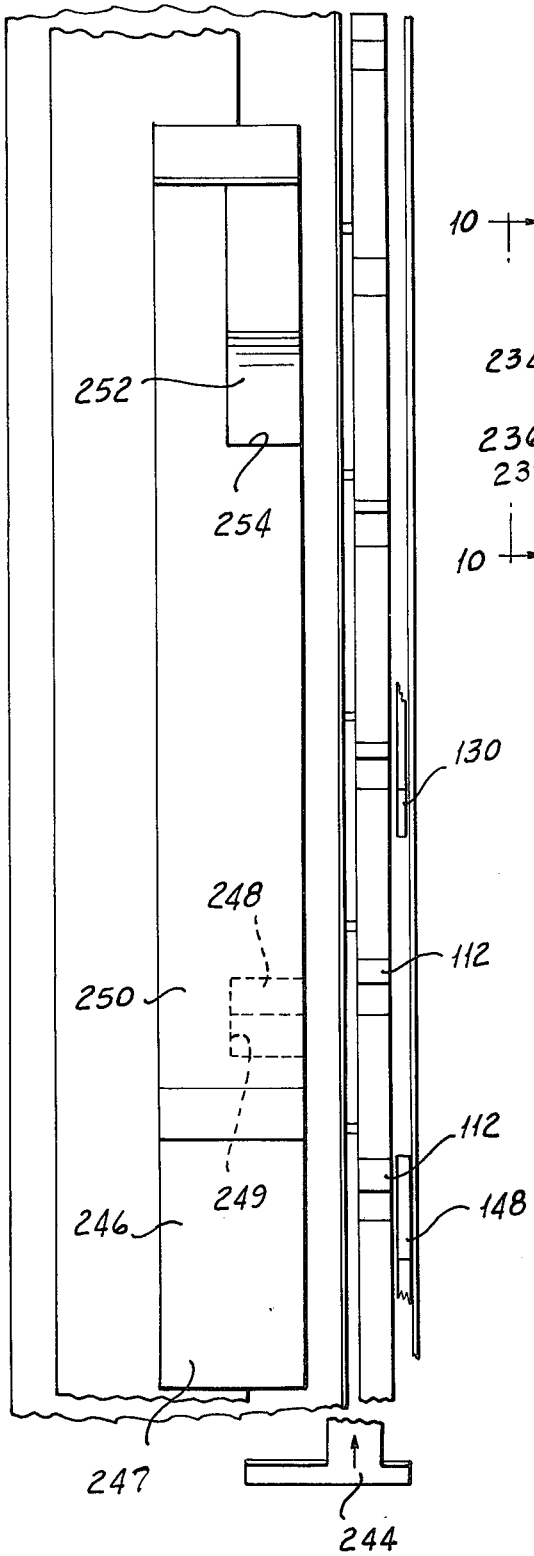
FIG. 8 is a fragmentary end elevation of one of the units of my machine taken along the line 8—8 of FIG. 7.
Figure 9:
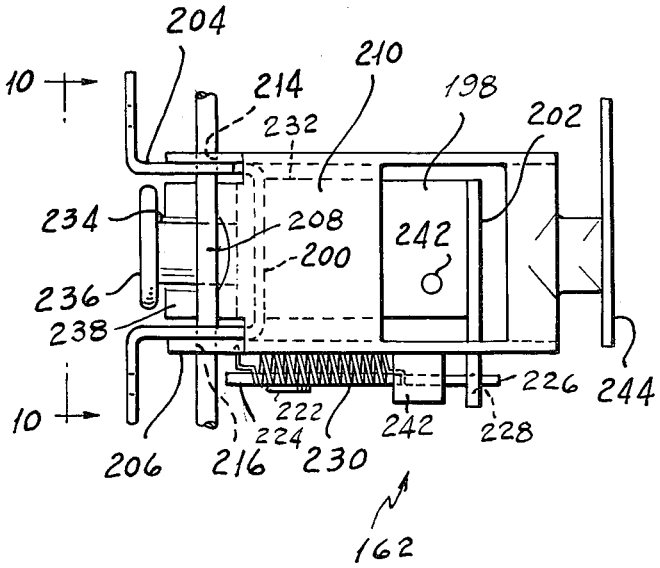
FIG. 9 is a top plan of one of the selecting assemblies of my improved merchandising machine.
Figure 10:
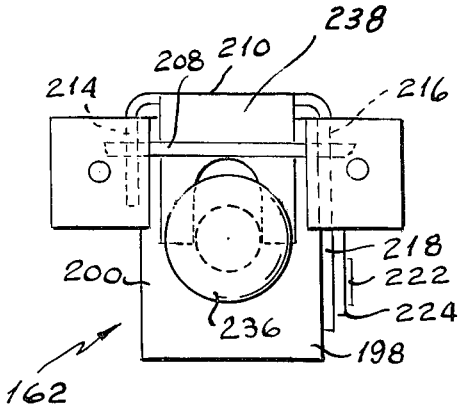
FIG. 10 is an end view of the assembly shown in FIG. 9 taken along the line 10—10 of FIG. 9.

A solenoid winding 232 is adapted to be energized to move an armature 234 to the left as viewed in FIG. 7 and to the right as viewed in FIG. 9 to cause the armature head 236 to engage a downwardly extending portion 238 of the driver member 210 to pivot the member in a clockwise direction as viewed in FIG. 7 to the broken line position illustrated therein. When that occurs, latch 224 moves to a position at which its hook 226 is in engagement with the upper end of the slot 228 releasably to hold the parts in the position illustrated in broken lines in FIG. 7. In this relative position of the parts, a nose 240 on the latch is adjacent to a reset flange 242 on the driver member 210 so that, in a manner to be described, if the drive member is positively moved in a counterclockwise direction, the flange 242 will engage the nose 240 on the latch to move the hook 226 out of engagement with the upper edge of the slot 228 so that the spring 230 restores the parts to the position shown in full lines in FIG. 7. I form the driver member 210 with a T-head 244 adapted to engage and to drive operating parts of the machine in a manner to be described As has been explained hereinabove, when the carrier 176 is moved along the arcuate slot and when one of the corresponding drive members 210 has been moved to operative position, the head 244 will be guided along a path at which it operates the various elements of the machine. I mount a first guide member 246 at a location at which it extends along a peripheral portion of the outer shroud adjacent to the arcuate slot. As the carriage of an actuated drive member 210 moves along its path, the lefthand portion of the T-head 244 as viewed in FIG. 8 is moved into the guide 246 by a flange 247. When this occurs, the other side of the T-head engages lever 148 to move the stop 154 out of its position adjacent to a tooth on the merchandise carrier. Next, the T-head 244 picks up a tooth 112 of the carrier and moves the carrier through a distance which is approximately equal to the angular extent of one compartment of the carrier. At the end of this movement, the lefthand portion of the head 244, as viewed in FIG. 8, engages a ramp 248 to cause the T-head to release the tooth and, at the same time, to move the drive member 210 in a counterclockwise direction, as viewed in FIG. 7, to release the latch 224 to permit the left-hand portion of head 244 to move out of an opening 249 in guide 246. However, when that occurs, the left-hand portion of the T-head, as viewed in FIG. 8, is caught by an outer guide plate 250 and held in a position at which it will engage the ejector operating level 130 as the carrier bar continues its movement. Finally, the T-head is completely released as it reaches a second ramp 252 positioned below an opening 254 in the outer plate 250. I provide the carrier bar 176 with a plurality of extensions 255 which, in the course of the return movement of the carriage to its home position, engage the ejector operating level 130 to ensure its return to home position in the event that it becomes stuck to such an extent that the force of spring 128 is not sufficient to return it to home position.

Figure 11:
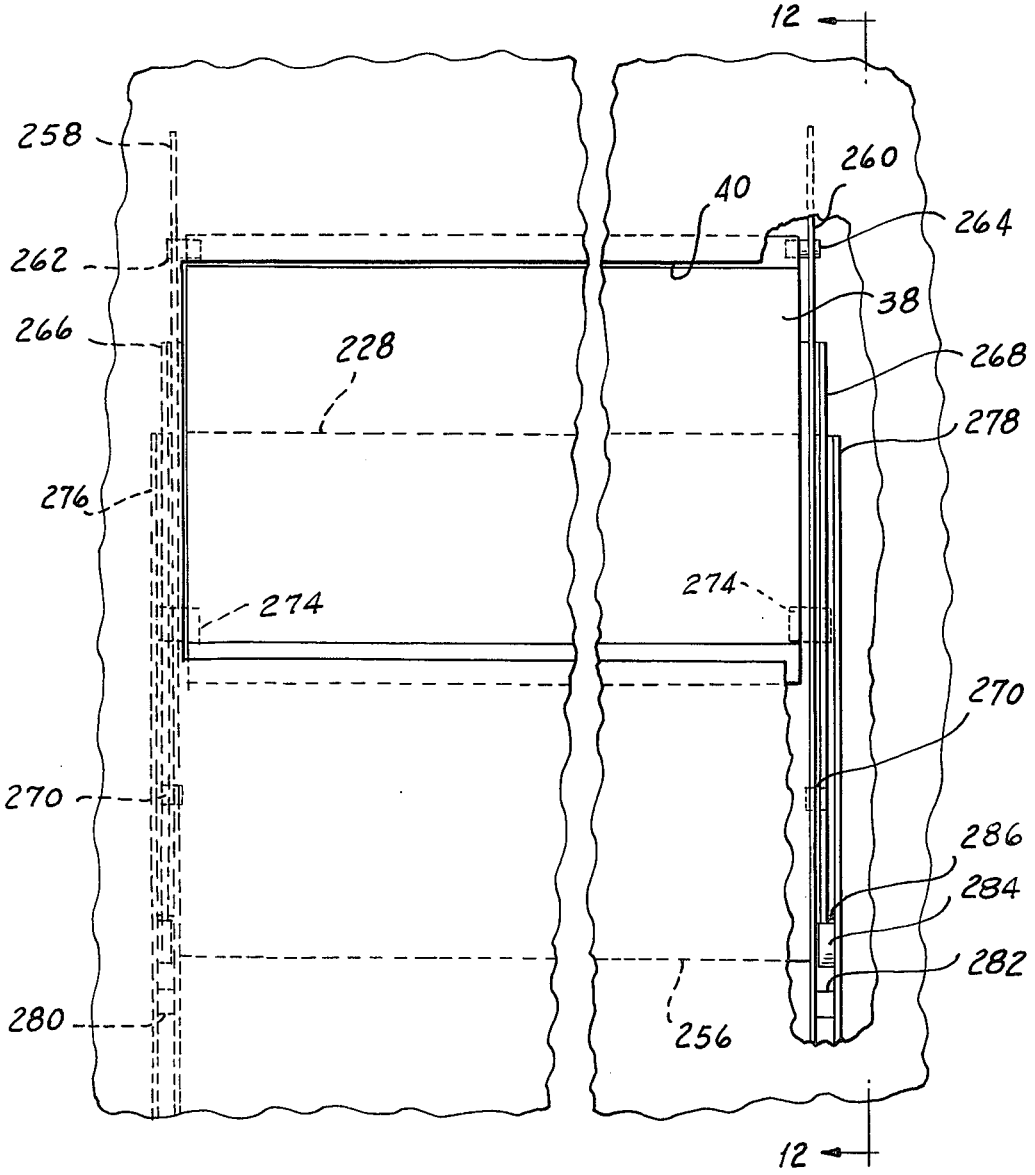
FIG. 11 is a fragmentary front elevation of a portion of my improved merchandising machine illustrating the delivery mechanism thereof.
Figure 12:
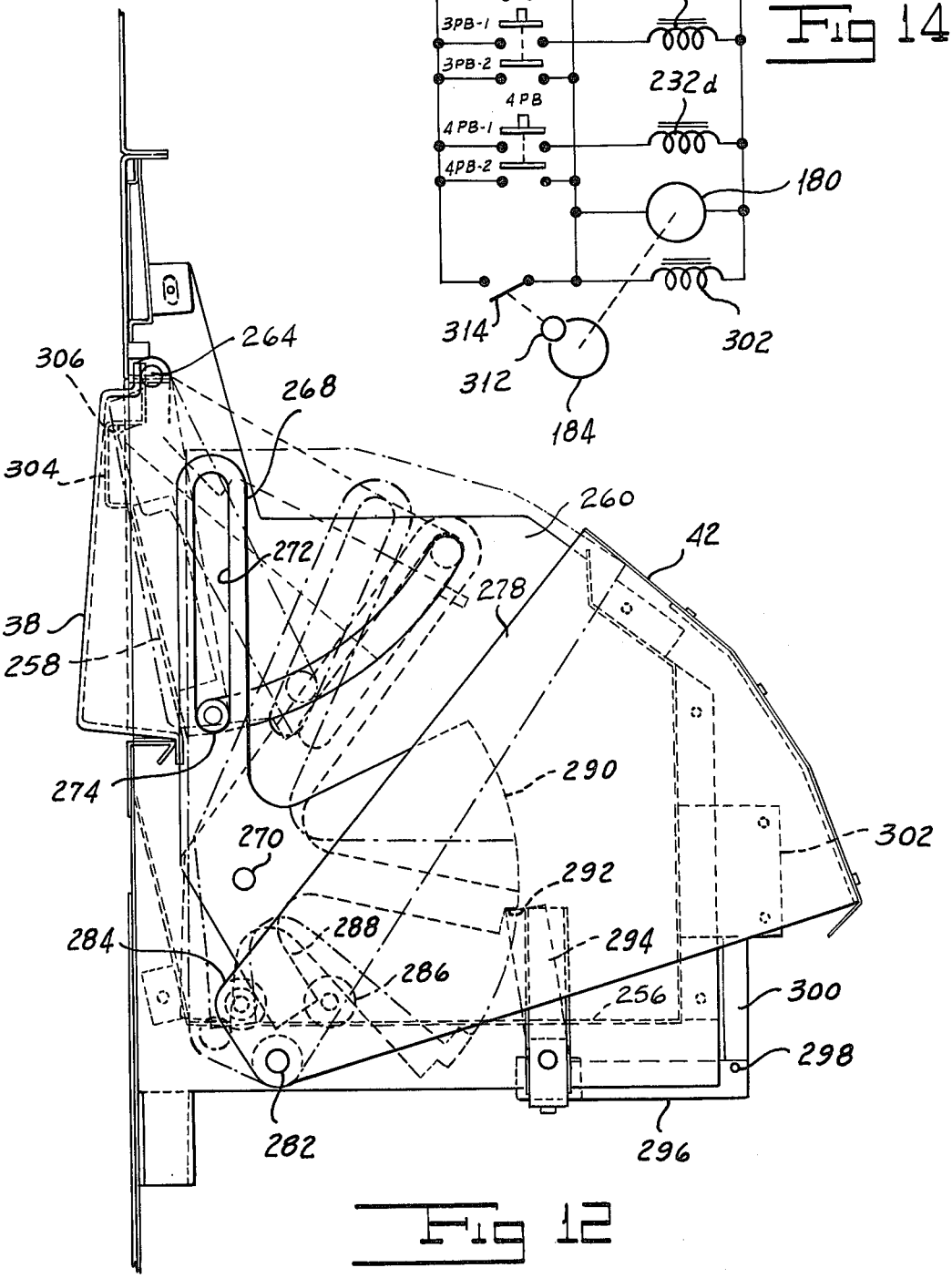
FIG. 12 is a sectional view of the portion of my apparatus illustrated in FIG. 11 taken along the line 12—12 thereof.
Figure 11:
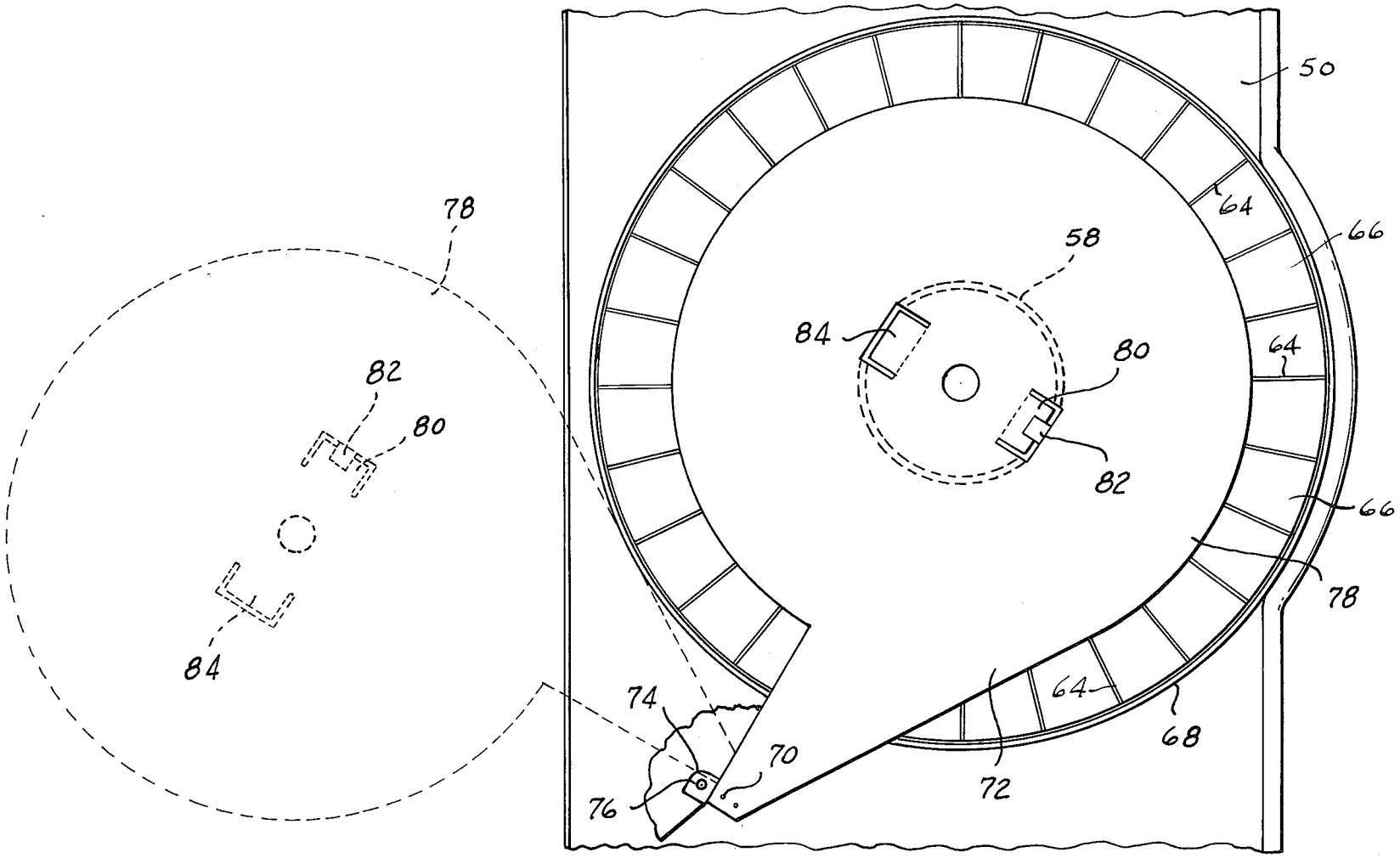

Referring now to FIGS. 11 and 12, the delivery mechanism of my improved merchandising machine includes a delivery tray 256 attached to the door of the machine cabinet by any suitable means for receiving an article of merchandise delivered by any one of the units of the machine. I provide the tray 256 with sides 258 and 260 and position the tray behind the delivery door 38 which is supported on pivots 262 and 264 carried by sides 258 and 260 for movement from a closed position over the delivery opening to which it is normally urged by the weight of the delivery mechanism to be described hereinafter. In order to gain access to the delivery tray 256, door 38 is pushed inwardly to permit the customer to reach into the tray and retrieve the article which has been delivered by the operated unit.

The delivery assembly includes a pair of baffle operating levers 266 and 268, each of which is supported on a respective pin 270 carried by one of the sides 258 and 260. Each of the baffle operating levers 266 and 268 is formed with an elongated slot 272 which receives a roller 274 carried by the door 38 at one side of the other thereof.

I provide the baffle plate 42 of my delivery assembly with a pair of arms 276 and 278 supported on respective pivot pins 280 and 282 carried by the sides 258 and 260. Each of the arms 276 and 278 carries a pair of spaced follower rollers 284 and 286 adjacent to the associated pivot 280 or 282. Each of the baffle operating levers 266 and 268 has a baffle actuating arm 288 which is disposed between the follower rollers 284 and 286 of the corresponding baffle plate arm 276 or 278.

I also form each of the baffle operating levers 266 and 268 with a locking arm 290 formed with a notch 292. In a manner to be described more fully hereinbelow, during the operating cycle of any of the units of my machine, a bell crank locking arm 294 is in a position, indicated in broken lines in FIG. 12, in which the upper end thereof is disposed in the notch 292 of the associated arm 290 to prevent pivotal movement thereof in response to operation of the door 38. The other arm 296 of the bell crank is pivotally connected by a pin 298 to the armature 300 of a solenoid 302 adapted to be energized during the operating cycle of any unit of the machine.

Once the operating cycle of a unit is complete, the door 38 is free to be pushed inwardly so that the arm 288 of each of the levers 266 and 268 acts on its associated pair of followers 284 and 286 to swing the baffle plate 42 upwardly first to an intermediate position illustrated in broken lines in FIG. 12 and then to a final position illustrated in dot-dash lines in FIG. 12. I mount a bracket 304 formed with a recess 306 inside the door 38 so that when the parts reach the position shown in dot-dash lines in FIG. 12, the upper edge of the baffle plate 42 is disposed within the recess 306 so as to prevent any dishonest person from working a tool up into the space between the baffle edge of the door. I have provided the delivery mechanism with the locking mechanism just described in order to avoid the possibility of an article being dispensed from being caught between the upper edge of the baffle plate 42 and the door if the door is opened too quickly in the course of a cycle of operation of any of the units.

Figure 14:
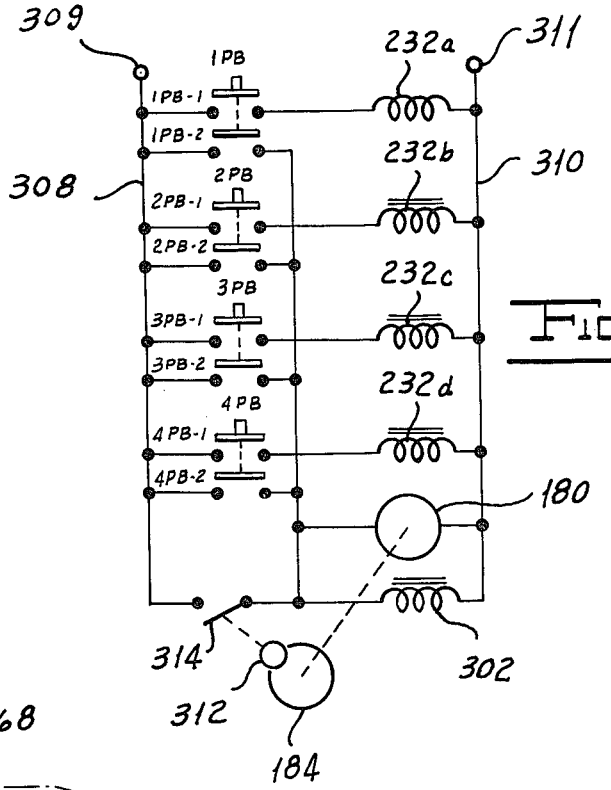
FIG. 14 is a schematic view of one form of electrical circuit which may be used to control my improved merchandising machine.

Referring now to FIG. 14, I have illustrated schematically one form of control circuit which may be used with my merchandising machine. The circuit includes a pair of conductors 308 and 310 connected to the terminals 309 and 311 of a suitable source of power. The circuit includes a plurality of push-buttons 1PB to 4PB as there are selections provided by the machine. For purposes of simplicity, I have limited the showing of FIG. 14 to four selections. I connect the first normally open switch contacts 1PB-1, 2PB-1 and so forth respectively in series between the conductor 308 and one of the selection solenoids **232*a* to 232*d*. I connect each of the other normally open switches 1PB-2, 2PB-2 and so forth of each of the push-button switches between line 308 and one terminal of motor 180, the other terminal of which is connected to conductor 310. The delivery door locking solenoid 302 is connected in parallel with the motor 180. In addition to operating the carriage drive follower, cam 184 actuates a follower 312 upon the initial movement of motor 180 to close a one-revolution switch 314 to cause the motor 180 and solenoid 302** to remain energized for a full cycle of operation of the machine.

In operation of my merchandising machine 10, a customer desiring to make a selection approaches the machine and deposits a sum in coins in slot 22 aggregating at least the purchase price of an article he desires to purchase. It will readily be appreciated that my machine might as well be provided with a bill acceptor of any suitable type known to the art and with means for making change by use of a suitable change maker of any type known in the prior art.

Having deposited the price of an article, the customer pushes one of the push-buttons 1PB to 4PB of the push-button array 20 corresponding to the article he desires to select. Actuation of the push-button momentarily energizes the corresponding solenoid winding **232*a* to 232*d* and, at the same time, energizes motor 180 and solenoid 302. Energization of the solenoid 302 positions bell crank arms 294 at positions at which the upper ends thereof are in notches 292 in the arms 290 of levers 266 and 268. Thus, the door 38 cannot at this time be opened to gain access to the interior of the machine. Energization of the solenoid 232 causes the associated drive member 210 to move to the broken line position illustrated in FIG. 7 and, at the same time, causes the latch 224 to move to a position at which the book 226 thereof engages the upper edge of the slot 228 to hold the drive member 210 in its operative position. As the motor 180 drives the cam 184, the carrier bars including the bar 116 begin to swing upwardly along arcuate paths adjacent to the article storage carrier plates with which they are associated. Assuming that the selected solenoid is on bar 116, the T-head 244 thereof beings to move upwardly with the carrier bar. When this occurs, the left-hand portion of the head 244 as viewed in FIG. 8 is guided by flange 247 into the space beneath guide plate 246. As this occurs, the head 244 first engages lever 94 to move it in a counterclockwise direction as viewed in FIG. 7 to move the stop thereon out of a position adjacent to a tooth 112 to permit counterclockwise movement of the merchandise carrier. Next, the T-head 244 engages a tooth 112 to drive the merchandise supply carrier in a counterclockwise direction as viewed in FIGS. 3 and 7**.

As the T-head 244 moves the carriage by virtue of the engagement of the head with one tooth 112, another tooth 112 thereon picks up the lug 114 on the upper baffle 108 of the escrow mechanism 84. This results in a clockwise rotation of lever 102 around pivot 104 to a position illustrated in broken lines in FIG. 3 at which the lower baffle 106 permits an article held on shelf 86 to move downwardly toward the delivery mechanism 36 of the machine. As the merchandise carrier completes a movement equal to the space occupied by one of the compartments 66, the left-hand side of T-head 244 as viewed in FIG. 8 engages a ramp 248 which moves the head outwardly through an opening 249 in the guide 246. By this time, latch 224 has been released so that the drive member 210 is permitted to return to its initial position. At the same time, head 244 is out of engagement with the tooth on the carrier so that the carrier is released. Concomitantly, the carrier tooth 112, which had been in engagement with the lug 114 on the upper baffle 108, releases the lug so that spring 110 is permitted to return the baffles 106 and 108 to their initial positions. When that occurs, the compartment 66 next to deliver its article at the assembly 84 is adjacent to opening 100 in shroud 68 so that the article can move out of the compartment 66 and onto the display shaft 86 of the assembly 84.

After moving out of the opening 249 under the action of the ramp 248, the T-head 244 is held in position by the second guide member 250 which causes the head to continue to move along its path until the right-hand end thereof as viewed in FIG. 8 engages the ejector lever arm 130 to swing the ejector lever around its pivot 126 against the action of the spring 128. As this occurs, bar 118 moves radially along a path defined by the guide 116 to cause the ejector 134 to move out of the space inside the stationary hub 58 and into the compartment 66 positioned to deliver its article to the assembly 84 positively to drive any article which might be stuck in the compartment from the compartment and onto the shaft 84. This action also obviates malfunction owing to inadvertent double loading of a compartment by the operator. Upon completion of movement of the ejector 134 into the compartment, the T-head 244 engages a second ramp 252 which moves it positively outwardly through an opening 255 so that the member 210 can assume its fully reset position.

After completion of the forward or delivery stroke, the carrier bar 116 swings back to its initial position. In the course of this movement, extension 255 moves along such a path as to engage ejector lever arm 130 and positively return the ejector assembly to its initial position in the event that, for any reason, it became stuck with such force that the spring 128 was unable to return the ejector mechanism to its initial position. It will be remembered that when cam 184 began its initial movement from its home position a follower 312 in engagement therewith closed a one-revolution switch 314 to maintain motor 180 and solenoid 302 energized for a full revolution of the motor shaft. As the revolution is complete, follower 312 permits the switch 314 to return to its open position so that both the motor 180 and the solenoid winding 302 are de-energized.

When the solenoid winding 302 is de-energized, bell crank arms 294 move out of the notches 292 in the arms 290 on the levers 266 and 268. The customer may now push in the door 38 to gain access to the shelf 256 to retrieve the article of merchandise. In the course of this operation, the rollers 274 rotate levers 266 and 268 so that the extensions or tails 288 thereon drive followers 284 on the sides of the baffle to move the baffle to a position at which it prevents the customer from reaching upwardly toward the supply carriers of the machine. In the fully operated position of the baffle, the forward edge thereof is received in the recess 306 formed in the bracket 304 carried by the door. This interaction further prevents any access to the interior of the machine by use of a tool or the like. As has been pointed out hereinabove, lock-out of the door in the course of a cycle of the machine prevents any article dropping toward the tray 256 from being caught between the upper edge of the baffle and the door.

It is to be understood that the various pairs of merchandise carriers supported on the panels 50 of my machine may be of different widths. That is to say, one pair of the units 56 may be relatively wide to dispense articles such, for example, as bags of chips or pretzels or the like, while the pair of units 56 on another panel 50 may be relatively narrow to dispense articles such, for example, as bars of candy or the like.

When the machine is to be serviced, the operator opens the door to gain access to the interior of the merchandise machine cabinet. Next, a suitable linkage is operated to move the locking element 196 out of the slots 192 to permit the panels 50 to be slid outwardly to loading position. When a panel has thus been moved outwardly, the cover plate 78 of the unit is swung in a counterclockwise direction as viewed in FIG. 13 fully to expose the sides of the compartments 66. As has been pointed out hereinabove, the material of which the retainer 78 is formed is slightly resilient to permit it to be pulled slightly away from the carrier to move the tongue 84 outboard of the hub 58 so that the panel for retainer plate 78 can be swung to a position at which the compartments are exposed. Next, the service man fills the compartments through the sides thereof and, when all compartments are full, swings the retainer plate 78 back to its initial position. Then the plate 50 is slid to a fully housed position and, when all compartments have been loaded, the member 196 is swung to a position at which it enters all of the slots 192 of the panels 50 to ensure that all units are accurately positioned adjacent to their respective operating mechanisms as is required for proper operation of the machine.

It will be seen that I have accomplished the objects of my invention. I have provided an improved merchandising machine which overcomes many of the defects of merchandising machines of the prior art. My machine incorporates a plurality of article supply and delivery units so constructed as to make most efficient use of the space available in the standard merchandising machine cabinet. My machine affords a wide selection of articles while, at the same time, maintaining a relatively large supply of each article. My machine displays the article next to be delivered to a customer. I provide my machine with means for positively driving an article out of a supply compartment and onto the escrow surface in the course of operation of the machine. My machine permits of relatively simple and expeditious loading of the storage compartments thereof while, at the same time, preventing accidental movement of articles out of these compartments as the units are returned to home position within the machine. I provide my machine with means for locking the delivery door out during a cycle of operation of any one of the units to prevent an article being delivered by a unit to the delivery tray from being caught between the anti-theft baffle and the door.

It will be understood that certain features and subcombinations are of utility and may be employed with reference to other features and subcombinations. This is contemplated by and is within the scope of my claims. It is further obvious that various changes may be made in details within the scope of my claims without department from the spirit of my invention. It is, therefore, to be understood that my invention is not to be limited to the specific details shown and described.

Having thus described my invention, what I claim is:

1. An article vending machine comprising, in combination:

a casing including a front wall portion having a delivery opening therein;

article receiving means carried by the casing adjacent the delivery opening;

rotary means mounted within the casing for rotational movement about a horizontal axis, the rotary means including a plurality of radially extending article storage compartments;

a display compartment disposed within the casing in a stationary position relative to the rotary means, the display compartment being located intermediate said rotary means and said article receiving means and including an upper end and a lower end, to permit the viewing of an article within the display compartment from the front of the machine, rotation of the rotary means carrying successive article storage compartments into juxtaposition with the upper end of said display compartment;

a display compartment door assembly distinct from said rotary means and the storage compartments thereof movable relative to the display compartment, the door assembly having a door portion for blocking the lower end of said display compartment;

operating means for rotating the rotary means through an angle sufficient to locate one of the article storage compartments in juxtaposition with the display compartment and for moving said door assembly to unblock the lower end of said display compartment and permit an article on display to drop by gravity into said article receiving means, an article within said one storage compartment thereupon dropping by gravity into the upper end of the display compartment; and means for returning said door assembly to its initial position to block the lower end of said display compartment.

2. An article vending machine comprising, in combination:

a casing including a front wall portion having a delivery opening therein and a display area adjacent the delivery opening;

article receiving means carried by the casing adjacent the delivery opening;

an upstanding panel supported within said casing;

rotary means mounted on the upstanding panel for rotational movement about a horizontal axis; the rotary means including a plurality of radially extending article storage compartments;

a display compartment disposed within the casing in a stationary position relative to the rotary means, the display compartment being located intermediate said rotary means and said article receiving means and including an upper end and a lower end, the display compartment being visible from said display area to permit the viewing of an article within the display compartment from the front of the machine, rotation of the rotary means carrying successive article storage compartments into juxtaposition with said display compartment;

a compartment door assembly pivotally movable relative to the display compartment, the door assembly having a door portion for blocking the upper end of said display compartment;

operating means for rotating the rotary means through an angle sufficient to locate one of the article storage compartments in juxtaposition with the display compartment and for pivoting said door assembly to block the upper end of said display compartment and thereby momentarily prevent the article within said one storage compartment from entering the display compartment; and means for returning said door assembly to its initial position to unblock the upper end thereof, the article in said one storage compartment dropping by gravity through the unblocked upper end into said display compartment.

3. An article vending machine as defined in claim 2, in which the upstanding panel is movable between an outer loading position and an inner operative position.

4. An article vending machine comprising, in combination:

a casing including a front wall portion having a delivery opening therein;

article receiving means carried by the casing adjacent the delivery opening;

rotary means mounted within the casing for rotational movement about a horizontal axis, the rotary means including a plurality of radially extending article storage compartments;

a display compartment disposed within the casing in a stationary position relative to the rotary means, the display compartment being located intermediate said rotary means and said article receiving means and including an upper end, a lower end, and a transparent panel to permit the viewing of an article within the display compartment from the front of the machine, rotation of the rotary means carrying successive article storage compartments into juxtaposition with said display compartment;

a compartment door assembly movable relative to the display compartment, the door assembly having upper and lower door portions for respectively and alternately blocking the upper and lower ends of said display compartment;

operating means for rotating the rotary means through an angle sufficient to locate one of the article storage compartments in juxtaposition with the display compartment and for pivoting said door assembly to unblock the lower end of said display compartment and permit an article on display to drop by gravity into said article receiving means and to block the upper end of said display compartment and thereby prevent the article within said one storage compartment from entering the display compartment;

means for returning said door assembly to its initial position to block the lower end of said display compartment and unblock the upper end thereof, the article in said one storage compartment dropping the gravity through the unblocked upper end into said display compartment; and an ejector mechanism movable into said one storage compartment in response to said operating means to insure the discharge of the article in said one compartment.

5. An article vending machine comprising, in combination:

a casing including a front wall portion having a delivery opening therein;

article receiving means carried by the casing adjacent the delivery opening;

an upstanding panel supported within said casing for movement between an outer loading position and an inner operative position;

rotary means mounted on the upstanding panel for rotational movement about a horizontal axis, the rotary means including a plurality of radially extending article storage compartments;

a display compartment disposed within the casing in a stationary position relative to the rotary means, the display compartment being located intermediate said rotary means and said article receiving means and including an upper end, a lower end, and a transparent panel to permit the viewing of an article within the display compartment from the front of the machine, rotation of the rotary means carrying successive article storage compartments into juxtaposition with said display compartment;

a compartment door assembly pivotally movable relative to the display compartment, the door assembly having upper and lower flange portions for respectively and alternately blocking the upper and lower ends of said display compartment;

operating means for rotating the rotary means through an angle sufficient to locate one of the article storage compartments in juxtaposition with the display compartment and for pivoting said door assembly pivoting to unblock the lower end of said display compartment and permit an article on display to drop by gravity into said article receiving means and to block the upper end of said display compartment and thereby momentarily prevent the article within said one storage compartment from entering the display compartment;

means for returning said door assembly to its initial position to block the lower end of said display compartment and unblock the upper end thereof, the article in said one storage compartment dropping by gravity through the unblocked upper end into said display compartment; and an ejector mechanism reciprocably movable into said one storage compartment in response to said operating means to insure the discharge of the article in said one compartment.

6. An article vending machine as defined in claim 5, in which the operating means comprises:

a drive motor supported within the casing; and linkage means movable into engagement with the periphery of the rotary means and responsive to the drive motor for rotating the rotary means.

7. An article vending machine as defined in claim 6, in which the linkage means includes a control cam connected to the drive motor, a solenoid mechanism, and a linkage arm connected between the control cam and the solenoid mechanism for moving said mechanism along an arcuate path.

8. An article vending machine which comprises, in combination:

a casing including a front wall portion having a delivery opening therein;

article receiving means carried by the casing adjacent the delivery opening;

rotary means mounted within the casing for rotational movement about a horizontal axis, the rotary means including a plurality of radially extending article storage compartments;

a display compartment disposed within the casing in a stationary position relative to the rotary means, the display compartment being located intermediate said rotary means and said article receiving means and including an upper end and a lower end, rotation of the rotary means carrying successive article storage compartments into juxtaposition with the upper end of said display compartment;

a display compartment door assembly distinct from said rotary means and the storage compartments thereof pivotally movable relative to the display compartment, the door assembly having a lower door portion for blocking the lower end of the display compartment; and operating means for rotating the rotary means through an angle sufficient to locate one of the article storage compartments in juxtaposition with the display compartment and for moving said door assembly to cause an article on display in the display compartment to drop by gravity from the lower end thereof into said article receiving means and an article within said one storage compartment dropping by gravity into the upper end of the display compartment.

9. An article vending machine comprising, in combination:

a casing including a front wall portion having a delivery opening therein;

article receiving means carried by the casing adjacent the delivery opening;

rotary means mounted within the casing for rotational movement about a horizontal axis, the rotary means including a plurality of radially extending article storage compartments;

a display compartment disposed within the casing in a stationary position relative to the rotary means, the display compartment being located intermediate said rotary means and said article receiving means and including an upper end and a lower end, rotation of the rotary means carrying successive article storage compartments into juxtaposition with the upper end of said display compartment; and a compartment door assembly pivotally movable relative to the display compartment, the door assembly having upper and lower door portions for respectively and alternately blocking the upper and lower ends of the display compartment; and operating means for rotating the rotary means through an angle sufficient to locate one of the article storage compartments in juxtaposition with the display compartment and for pivoting said door assembly to cause an article on display in the display compartment dropping by gravity from the lower end thereof into said article receiving means and an article within said one storage compartment dropping by gravity into the upper end of the display compartment.

10. An article vending machine comprising, in combination:

a casing including a front wall portion having a delivery opening therein;

article receiving means carried by the casing adjacent the delivery opening;

an upstanding panel supported within said casing for movement between an outer loading position and an inner operative position;

rotary means mounted on the upstanding panel for rotational movement about a horizontal axis, the rotary means including a plurality of radially extending article storage compartments;

a display compartment disposed within the casing beneath the rotary means and including an upper and lower end, rotation of the rotary means carrying successive article storage compartments into juxtaposition with the upper end of said display compartment;

a display compartment door assembly distinct from said rotary means and the storage compartments thereof cooperating with the display compartment for selectively blocking the upper and lower ends thereof; and operating means for rotating the rotary means through an angle sufficient to locate one of the article storage compartments in juxtaposition with the display compartment and for moving said door assembly to enable the discharge of an article from said one storage compartment, said operating means including a control device selectively movable into engagement with the periphery of the rotary means to rotate the same.

11. In a merchandising machine, apparatus including a cabinet having a front formed with a delivery opening, means within said cabinet above said opening for holding a supply of articles of merchandise, an article receiving tray in said cabinet behind said opening, said tray having an open top through which it is adapted to receive an article of merchandise, means operable during a cycle of operation of said machine for causing an article from said supply to be delivered to said tray, a door, means mounting said door in said opening for pivotal movement around its upper edge in a direction rearwardly of said cabinet from a closed position blocking said opening to an open position generally over the top of said tray, a baffle, means mounting said baffle for swinging movement from an inactive position at the rear of said tray forwardly to an active position over said tray, and means responsive to movement of said door from said closed position to said open position for moving said baffle from its inactive position to its active position, the construction and arrangement being such that portions of said door and said baffle overlap in the active position of the baffle substantially completely to close the open top of said tray.

12. Apparatus as in claim 11 including means forming a recess on the inner surface of said door for receiving an edge of said baffle in the open position of said door and second position of said baffle.

13. Apparatus as in claim 11 including means for locking said door during operation of said machine.

14. Apparatus as in claim 12 in which said baffle moving means comprises a lever, means responsive to movement of said door for pivoting said lever and means responsive to pivoting of said lever for moving said door.

15. Apparatus as in claim 14 in which said means responsive to movement of said door comprises a roller and slot connection between one arm of said lever and said door and in which said means responsive to pivoting of said lever includes follower means on said baffle actuated by the other arm of said lever.

16. Apparatus as in claim 14 in which said locking means includes means for preventing pivotal movement of said lever.

17. Apparatus as in claim 16 in which said locking means comprises a third arm on said lever, said third arm being formed with a notch, a latch, means mounting said latch for movement between a position in said notch and a position out of said notch, and means responsive to cycling of said machine for moving said latch into said notch.

18. Apparatus as in claim 16 in which said machine has a main drive motor and in which said means responsive to cycling of said machine comprises a solenoid adapted to be energized to move said latch into said notch and means responsive to operation of said drive motor for energizing said solenoid.

19. In a merchandising machine, apparatus including a cabinet, an access opening in said cabinet, a delivery tray in said cabinet behind said opening, apparatus for holding a supply of articles of merchandise to be dispensed, means adapted to be actuated to deliver an article from said supply to said tray, a door, means mounting said door on said cabinet for movement inwardly of said cabinet from a closed position at which said tray is inaccessible to an open position at which said tray is accessible, a baffle having a forward edge, means mounting said baffle for movement from an inactive position at which said tray is open to receive an article to an active position between said tray and said delivery means, means responsive to movement of said door from said closed position to said open position for moving said baffle from said inactive position to said active position, and means on the inside of said door for receiving said forward edge of said baffle in the open position of said door and the active position of said baffle.

20. In a merchandising machine, apparatus including a cabinet, a plurality of merchandise delivery units in said cabinet, each of said units comprising a generally vertically extending panel, a merchandise supply carrier formed with a plurality of compartments adapted to receive articles of merchandise, means mounting said supply carrier on said panel for successive movement of said compartments past a delivery location, said panel closing first sides of said compartments said carrier compartments having open ends and having open second sides remote from said panel, means on said panel for closing the ends of said compartments around the periphery of said supply carrier outside said delivery location, means mounting said panel in said cabinet for movement independently of other panels between a housed position at which said compartments are inaccessible through the open sides thereof and a loading position at which said compartments are accessible through said open sides, and means on each of said units for preventing articles from accidentally falling out of said compartment open second sides when the panel of the adjacent unit has been moved to loading position.

21. Apparatus as in claim 20 in which said preventing means includes a cover plate and means mounting said cover plate on said panel for movement between a first position over the open second sides of said compartment at which it prevents articles from accidentally falling outwardly through said open second sides and a position at which said open second sides are uncovered to permit loading of said compartments.

22. Apparatus as in claim 21 including means for releasably retaining said cover plate in position over said open second sides of said compartments.

23. Apparatus as in claim 22 in which said supply carrier mounting means includes a hollow hub on said panel, said releasable retaining means comprising a pair of spaced inwardly bent tongues on said plate and an inwardly directed tab on said hub, the arrangement being such that one of said tongues rides under said tab while the other of said tongues snaps into position behind said hub as said plate moves from said second position to said first position.

24. In a merchandising machine, apparatus including in combination, a cabinet, a delivery opening in said cabinet, a generally vertically disposed panel in said cabinet, an upper merchandise carrier having a multiplicity of storage compartments for holding the respective articles of a supply of articles, means mounting said upper carrier for rotary movement on said panel around a generally horizontal axis, means including said upper carrier adapted to be driven to deliver an article of merchandise to a location within the cabinet adjacent to said delivery opening, a lower merchandise carrier having a multiplicity of storage compartments for holding the respective articles of a supply of articles of merchandise, means mounting said lower carrier for rotary movement on said panel around a generally horizontal axis, means including said lower carrier adapted to be driven to deliver an article of merchandise to said location adjacent to said delivery opening, and respective selectively actuatable drive means associated with the respective upper and lower carrier article delivery means for selectively driving one of said carrier article delivery means on an operation of said machine to cause an article from one of said carriers to be delivered to said location.

25. Apparatus as in claim 24 in which each of said carriers is generally circular in shape and is provided with a plurality of generally radially extending compartments.

26. Apparatus as in claim 25 including a window in said cabinet, and in which said means including said upper carrier includes an upper escrow assembly having a display surface positioned behind said window and adapted to receive an article from a compartment of said upper carrier, and in which said means including said lower carrier includes a lower escrow assembly having a display surface positioned behind said window and adapted to receive an article from a compartment of said upper carrier, each of said escrow assemblies adapted to be actuated to deliver an article from its display surface to said location adjacent to said delivery opening, and in which said selectively actuatable drive means comprises means for actuating the escrow means corresponding to the carrier being driven.

27. Apparatus as in claim 26 including a delivery door, means mounting said door on said cabinet for movement between a position at which it closes said delivery opening to prevent access to said location and an open position at which it permits access to said delivery opening and means for locking said door in said closed position in the course of a cycle of operation of said machine.

28. Apparatus as in claim 26 in which said selectively actuatable drive means comprises respective coupling means associated with said upper and lower carriers, means mounting said coupling means for movement adjacent to said carriers, said coupling means being selectively actuatable to engage their respective carriers, and a common drive means for said selecting means to cause the actuated coupling means to drive its associated carrier.

29. Apparatus as in claim 28 including a plurality of generally vertically extending panels, respective upper and lower carriers on each of said panels, respective selecting means associated with all of said carriers, and in which said mounting means comprises an upper carriage for supporting said selecting means associated with said upper carriers and a lower carriage for supporting said selecting means associated with said upper carriers.

30. Apparatus as in claim 28 in which said common drive means comprises a link connecting said carriage, a cam, a follower adapted to engage same cam, a link connecting same follower to one of said carriage, and means including a torsion bar for holding said follower in engagement with said cam.

31. Apparatus as in claim 30 including an arm on said torsion bar and means connecting said arm to said carriage connecting link.

32. A merchandising machine including in combination, a cabinet, a delivery opening in said cabinet, a window in said cabinet, a merchandise delivery unit comprising a generally circular merchandise supply carrier having a plurality of radially extending compartments adapted to receive articles of merchandise, each of said compartments extending from the periphery of the carrier radially inwardly thereof for a distance greater than one-half of the radius of the carrier, means mounting said carrier for rotary movement in said cabinet, an escrow assembly distinct from said carrier and the compartments thereof disposed in said cabinet between said carrier and said delivery opening, said escrow assembly providing a display surface positioned behind said window and adapted substantially fully to receive a complete article from a carrier compartment positioned adjacent thereto, said escrow assembly adapted to be actuated to delivery an article from said display surface to a location adjacent to said delivery opening, means operable during a cycle of said unit for actuating said escrow assembly and for rotating said carrier to position a compartment thereof adjacent to said display surface.

33. A merchandising machine as in claim 32 including an ejector, means mounting said ejector in operative relationship with said carrier for movement between a retracted position and an extended position in a compartment of said carrier adjacent to escrow assembly, and in which said means operative during a cycle of operation of said unit includes means for moving said ejector between said positions.

34. A merchandising machine as in claim 32 including a delivery door, means mounting said door on said cabinet for movement between a closed position over said delivery opening at which it prevents access to said location and an open position at which said location is accessible, and means operative during said cycle of operation of said unit for locking said door in said closed position.

35. A merchandising machine as in claim 32 including an ejector, means mounting said ejector in operative relationship with said carrier for movement between a retracted position and an extended position in a compartment of said carrier adjacent to said escrow assembly, a delivery door, means mounting said door on said cabinet for movement between a closed position over said delivery opening at which it prevents access to said location and an open position at which said location is accessible, and in which said means operative during a cycle of operation of said unit includes means for moving said ejector between said positions and means for locking said door in said closed position.

36. A machine as in claim 32 in which said carrier driving means rotates said carrier in a certain direction, said machine including means normally preventing rotation of said supply means in said certain direction and means operable during said cycle of said unit for disabling said preventing means.

37. A machine as in claim 36 including means normally preventing movement of said supply means in a direction opposite to said certain direction.

38. An article vending machine including in combination, a housing having a wall formed with a delivery area, a display window in said wall, escrow means in said cabinet behind said window, said escrow means being actuatable between a first condition at which it retains an article in a position to be viewed through said window and a second condition at which an article moves from said escrow means to said delivery area, a merchandise carrier having a plurality of merchandise storage compartments, means mounting said carrier in said housing for movement of said compartments past said escrow means, an article ejector, means mounting said ejector for movement from a retracted position out of a compartment positioned in registry with said escrow means to an extended position into said compartment in registry positively to move an article to said escrow means, and means operable in the course of a cycle of said machine for moving said article carrier to position a compartment in registry with said escrow means and for actuating said escrow means from said first condition to said second condition and back to said first condition and for moving said ejector from said retracted position to said extended position with said escrow means in said first condition.

39. A machine as in claim 38 in which said means operable in the course of a machine cycle sequentially actuates said escrow means from said first condition to said second condition and then moves said article carrier to position a compartment in registry with said escrow means and then moves said ejector from said retracted position to said extended position.

40. A machine as in claim 38 in which said means operable during a cycle of operation of said unit includes a drive member mounted for movement along a path adjacent to said carrier, selectively engageable interengageable means on said drive member and on said carrier adapted to be engaged to move said carrier through a distance equal to the space occupied by one of said compartments in the course of a first predetermined movement of said drive member along said path and means responsive to a further movement of said drive member along said path for moving said ejector from said retracted position to said extended position.

41. A machine as in claim 40 including means responsive to said movement of said carrier for actuating said escrow assembly.

42. A machine as in claim 41 in which said means responsive to movement of said carrier comprises second interengageable means on said carrier and on said escrow assembly.

43. A machine as in claim 32 in which said display surface is an inclined stationary display surface, and in which said escrow assembly include respective upper and lower retainers positioned adjacent to the respective ends of said surface, means mounting said retainers for concomitant movement between first positions at which said lower retainer holds an article in position on said surface while said upper retainer is relatively inactive and second positions at which said lower retainer permits an article to move from said surface to said location adjacent to said delivery opening and at which said upper retainer moves to a position at which it blocks a compartment moving into position to deliver its article to said surface, and in which said means operable during said cycle comprises means for moving said retainer from said first positions to said second positions.

44. A merchandising machine as in claim 38 in which said supply carrier mounting means comprises a panel, each of said compartments having open ends and open sides remote from said panel, means for closing the ends of said compartments remote from said escrow assembly, means mounting said panel in said cabinet for movement from a housed position to a loading position, said panel and the carrier supported thereby comprising a unit of said machine, said machine including a plurality of said units and means for preventing articles from accidentally falling out of the open sides of a housed unit when the unit adjacent thereto has been moved to loading position.

45. A merchandising machine as in claim 44 in which said means for preventing articles from falling may be disabled when said housed unit is moved to loading position.

46. A merchandising machine as in claim 32 in which said carrier mounting means supports said carrier for movement between a housed position in said cabinet and a loading position, and in which said carrier driving means is supported in said cabinet, said machine including releasable means for accurately locating and locking said carrier in said cabinet at a position at which it is in operative relationship with said drive means.

47. In a merchandising machine, a cabinet, a plurality of article supply carriers, each of which includes a plurality of compartments adapted to receive articles of merchandise, a plurality of supports for said article supply carriers, a carriage, means mounting said carriage on said cabinet for movement with an operating and with a return stroke, a plurality of selectively actuatable coupling means adapted to be activated to couple their associated supply carriers with said carriage, means mounting said supports for individual movement from retracted positions at which the supply carriers are operatively associated with the selectively actuatable coupling means and extended positions at which said supply carriers can be loaded, and releasable means for locating and positively holding said supports in said retracted positions at which the article supply carriers are in proper operative relationship with the associated selecting means to ensure correct operation thereof.

48. An article vending machine comprising, in combination:

a casing including a front wall portion having a delivery opening therein;

article receiving means carried by the casing adjacent the delivery opening;

rotary means mounted within the casing for rotational movement about a horizontal axis, the rotary means including a plurality of radially extending article storage compartments;

a display compartment disposed within the casing in a stationary position relative to the rotary means, the display compartment being located intermediate said rotary means and said article receiving means and including an upper end and a lower end to permit the viewing of an article within the display compartment from the front of the machine, rotation of the rotary means carrying successive article storage compartments into juxtaposition with the upper end of said display compartment;

a compartment door assembly movable relative to the display compartment, the door assembly having a door portion for blocking the lower end of said display compartment and having an additional door portion for blocking and unblocking the upper end of the display compartment;

operating means for rotating the rotary means through an angle sufficient to locate one of the article storage compartments in juxtaposition with the display compartment and for moving said door assembly to unblock the lower end of said display compartment and permit an article on display to drop by gravity into said article receiving means, and to block the upper end of said display compartment, an article within said one storage compartment thereupon dropping by gravity into the upper end of the display compartment; and means for returning said door assembly to its initial position to block the lower end of said display compartment and to unblock the upper end of the display compartment.

49. In a merchandising machine, apparatus including in combination, a cabinet, a delivery opening in said cabinet, an upper merchandise carrier having a multiplicity of storage compartments for holding the respective article of a supply of articles, means mounting said upper carrier in said cabinet for rotary movement around an upper generally horizontal axis, means including said upper carrier adapted to be driven to deliver an article to a location adjacent to said delivery opening, a lower merchandise carrier having a multiplicity of storage compartments for holding the respective articles of a supply of articles of merchandise, means mounting said lower carrier in said cabinet for rotary movement around a lower generally horizontal axis disposed below said upper axis, means including said lower carrier adapted to be driven to deliver an article of merchandise to said location adjacent to said delivery opening, and respective selectively actuatable drive means associated with the respective upper and lower carrier article delivery means for selectively driving one of said carrier article delivery means on an operation of said machine to cause an article from one of said carriers to be delivered to said location.

50. Apparatus as in claim 49 in which each of said carriers is generally circular in shape and is provided with a plurality of generally radially extending compartments.

* * * * *

UNITED STATES PATENT OFFICE

CERTIFICATE OF CORRECTION

Patent No. 4,087,020 Dated May 2, 1978

Inventor(s) Merrill Krakauer

It is certified that error appears in the above-identified patent and that said Letters Patent are hereby corrected as shown below:

Column 14, line 23, "the" (first occurrence) should read -- by --.

Column 22, line 2, after "operating" insert -- stroke --.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*